United States Patent [19]

Giesbrecht et al.

[11] Patent Number: 4,964,200

[45] Date of Patent: Oct. 23, 1990

[54] LEAD MAKING MACHINE HAVING IMPROVED CRIMPING PRESSES AND ACTUATING MECHANISM

[75] Inventors: Wayne E. Giesbrecht, Hersey; Howard C. Phillips; David J. Erb, both of Harrisburg, all of Pa.

[73] Assignee: AMP Incorporated, Harrisburg, Pa.

[21] Appl. No.: 396,893

[22] Filed: Aug. 22, 1989

[51] Int. Cl.[5] ..... H01R 43/04

[52] U.S. Cl. ..... 29/33 M; 29/564.4; 29/753

[58] Field of Search ..... 29/33 M, 564.4, 564.6, 29/748, 753, 564.7, 564.8, 565, 566, 747

[56] References Cited

U.S. PATENT DOCUMENTS

| | | | |
|---|---|---|---|
| 3,019,679 | 2/1962 | Schwalm et al. | 81/9.51 |
| 3,612,369 | 10/1971 | Grebe et al. | 226/24 |
| 3,800,389 | 4/1974 | Brehm et al. | 29/203 D |
| 3,861,018 | 1/1975 | Matsura et al. | 29/747 X |
| 3,867,754 | 2/1975 | Koch | 29/564.4 X |
| 3,883,938 | 5/1975 | Schmidt et al. | 29/753 X |
| 4,516,309 | 5/1985 | Clark | 29/564.4 |
| 4,554,725 | 11/1985 | Over et al. | 29/564.4 |
| 4,631,823 | 12/1986 | Collier et al. | 29/564.4 X |

FOREIGN PATENT DOCUMENTS

| | | | |
|---|---|---|---|
| 623909 | 7/1961 | Canada | 29/33 M |
| 0034433 | 8/1981 | European Pat. Off. | 29/753 |
| 0212869 | 3/1987 | European Pat. Off. | 29/753 |
| 2163977 | 1/1979 | Fed. Rep. of Germany | 29/73 |
| 1251215 | 12/1960 | France | 29/33 M |

*Primary Examiner*—William Briggs

[57] ABSTRACT

Lead making machine has crimping presses in which the press ram comprises a vertically extending reciprocable rod which is contained in a vertically extending static press frame. The rod and press frame have laterally extending arms between which a terminal applicator is mounted with the applicator frame supported on the arm of the press frame and with the applicator ram coupled to the rod. The stresses developed during a crimping operation are confined to the rod and press frame and are not borne by the housing in which the presses and the actuating mechanism is contained. The presses are vertically adjustable with respect to the housing.

24 Claims, 11 Drawing Sheets

7
5
3
5'
4
5
5'
3
6

5
3
5'

6'
24'
24
6
6

5
3
6'
2
4
4
6
6
5'

14
116
114
114
110
52
134
60
84
88
82
102
58
126
110
94
52
68
120
118
82
90
130
86
128
122
92
132
124
100
112

LEAD MAKING MACHINE HAVING IMPROVED CRIMPING PRESSES AND ACTUATING MECHANISM

FIELD OF THE INVENTION

This invention relates to lead making machines of the type which produce electrical leads and which comprise a feeding means for feeding wire from a spool or the like, wire cutting and insulation stripping means for cutting a lead from the end of a wire, crimping presses for crimping terminals onto the cut ends, and transferring mechanisms for transferring the cut ends from a cutting and stripping station to the crimping presses. The invention also relates to an improved crimping press which might be used under circumstances other than in a lead making machine.

BACKGROUND OF THE INVENTION

U.S. Pat. No. 3,019,697 describes an integrated lead making machine having a pair of crimping presses on each side of a wire feed path. The machine feeds wire by means of a wire feeding means from an endless wire source through a wire cutting and stripping zone and through aligned transfer mechanisms. In the operation of machines of this type, the wire is fed during each operating cycle, a lead is cut from the end of the fed wire, and the transfer mechanisms transfer the cut ends, from which the insulation is stripped during transfer, to the crimping presses. This type of lead making machine is now available from several different manufacturers and the principles of the lead making machine described in the above-identified U.S. patent are widely used. Other lead making machines of the same general type are described in U.S. Pat. Nos. 3,800,389; 3,612,369; and 4,554,725. These previously issued U.S. patents are hereby incorporated by reference into the instant description.

Lead making machines of the type described in the above U.S. patents are, of necessity, relatively complex and require complicated mechanisms for actuating the crimping presses and the wire and lead transfer mechanisms as well as the insulation cutting and stripping devices. It is common practice, for example, to provide each of the crimping presses as a self-contained unit and it is also common practice to provide these presses as conventional crimping presses having a separate press frame and press ram. In addition to being relatively complex, many of the presently available lead making machines are relatively massive and require heavy duty motors for their operation. Additionally, problems are sometimes encountered in the operation of transferring the cut ends of the wire and the lead to the crimping presses because of the fact that the crimping presses and the crimping tooling carried by the presses are in fixed positions on the machine and the wire and lead must be transferred from the cutting and stripping zone to the presses without encountering other structure mounted in the machine.

The present invention is directed to the achievement of an improved lead making machine having improved press assemblies which require less space and less power for their actuation than previous press assemblies and lead making machines, improved actuator systems for lead making machines, adjustment features which are not available in present lead making machines, and other advantages described below. In accordance with a further aspect, the invention is directed to the achievement of an improved crimping press and actuator which can be used under a variety of circumstances other than in lead making machines.

THE INVENTION

In accordance with one aspect thereof, the invention comprises a crimping press assembly for crimping electrical terminals onto the ends of wires. The press assembly has fixed tool holder means and movable tool holder means which have fixed and movable crimping tooling thereon, respectively. The press assembly comprises a static press frame and a reciprocable ram, the fixed tool holder means being carried by the press frame and the movable tool holder means being carried by the ram. Actuating means are provided for reciprocating the ram thereby to move the movable crimping tooling between an open position and a closed position. The movable tooling is remote from the fixed tooling when it is in its open position and is proximate to the fixed tooling when it is in its closed position. The crimping press assembly is characterized in that the actuating means comprises a reciprocable rod and actuating mechanism for reciprocating the rod. The frame means is in surrounding and guiding relationship to the rod. The rod is parallel to the ram and has one of its ends adjacent to the ram. The rod is connected to the ram at the one end. The actuating means has a first portion which is in engagement with the rod and which imparts reciprocative motion to the rod and the actuating means has a second portion which is in engagement with the frame so that during crimping of an electrical terminal onto a wire, the reaction forces resulting from the crimping process are transmitted from the movable and fixed tooling to the rod and the frame means, respectively, and through the first and second portions of the actuating means. In accordance with a further embodiment, a housing for the press assembly is provided which has one surface that extends normally of the axis of the rod and is proximate to the one end of the rod. Adjusting means are provided for adjusting the location of the press assembly in directions parallel to the directions of reciprocation of the rod so that the positions of the fixed and movable crimping tooling relative to the one surface of the housing can be adjusted.

In accordance with a further aspect, the invention is characterized in that the press assembly is part of a lead making machine having an operating zone. The operating zone has therein the fixed and movable crimping tooling, a wire cutter, terminal feeding means for intermittently feeding terminals to a position between the fixed and movable tooling, wire feeding means for feeding wire along a wire feed path which extends past the cutter, and transferring means. Upon actuation of the wire cutter subsequent to feeding wire along the wire feed path, a lead is cut from the fed wire and the cut ends of the lead and the wire which extends from an endless source will be in the operating zone. The transferring means is effective to transfer one of the cut ends from a location adjacent to the cutter to a location between the fixed and movable crimping tooling. The adjusting means permits adjustment of the fixed and movable tooling relative to the cut end which is transferred thereby to ensure precise placement of the cut end relative to the tooling.

In accordance with further aspects thereof, the invention is characterized in that the actuating means comprises a toggle mechanism having first and second toggle links which are pivoted to each other at a knee joint. The first portion of the actuating means is the first link and the second portion of the actuating means referred to above is the second link. The first and second links are pivoted to the rod and the frame means respectively. The frame means and the rod have a common axis and the first and second links are pivoted to the rod and frame means respectively on spaced-apart pivotal axes which intersect the common axis of the rod and the frame means.

In accordance with the preferred embodiment, the toggle mechanism is broken and the knee joint thereof is spaced laterally from the common axis when the movable tooling is in its open position, the knee joint being moved towards the common axis when the movable tooling is moved from its open position toward its closed position. Advantageously, the knee joint is on the common axis and the toggle mechanism is straightened with the first and second links in alignment on the common axis when the movable tooling is in its closed position.

In accordance also with the preferred embodiment, the force applying means are provided for straightening the toggle mechanism and returning the toggle mechanism to its broken condition during each operating cycle of the press assembly. The force applying means is mechanically connected to the toggle mechanism and is capable of applying a force thereto in directions normal to the common axis. The force applying means is connected to the toggle mechanism by a pivotal connection which is movable relative to the toggle mechanism during adjustment of the press assembly as explained above. The force applying mechanism comprises an actuator link means which extends transversely of the common axis and past the toggle mechanism, the pivotal connection of the force applying means being a pivotal connection between the actuator link means and one of the toggle links. The actuator mechanism may further comprise a four bar linkage system having two parallel swinging links on opposite sides of the common axis and a connecting link extending between the swinging links. The connecting link is pivotally connected intermediate its ends to one of the toggle links and a power source is provided for swinging the swinging links. The power source may comprise an eccentric and a power transmitting link extending from the eccentric to the connecting link.

A preferred embodiment of the invention has a single power source for the entire machine excepting the wire feeding system. The power source comprises an electric motor having an output shaft and a power transmission assembly, the transmission assembly having an input shaft and a plurality of output shafts. The output shafts of the motor are coupled to the input shaft of the power transmission assembly. The wire cutter, the crimping presses, and the transferring means are coupled to the output shaft of the transmission assembly.

THE DRAWING FIGURES

THE DISCLOSED EMBODIMENT

Figures 1A, 1B, 1C, 1D:
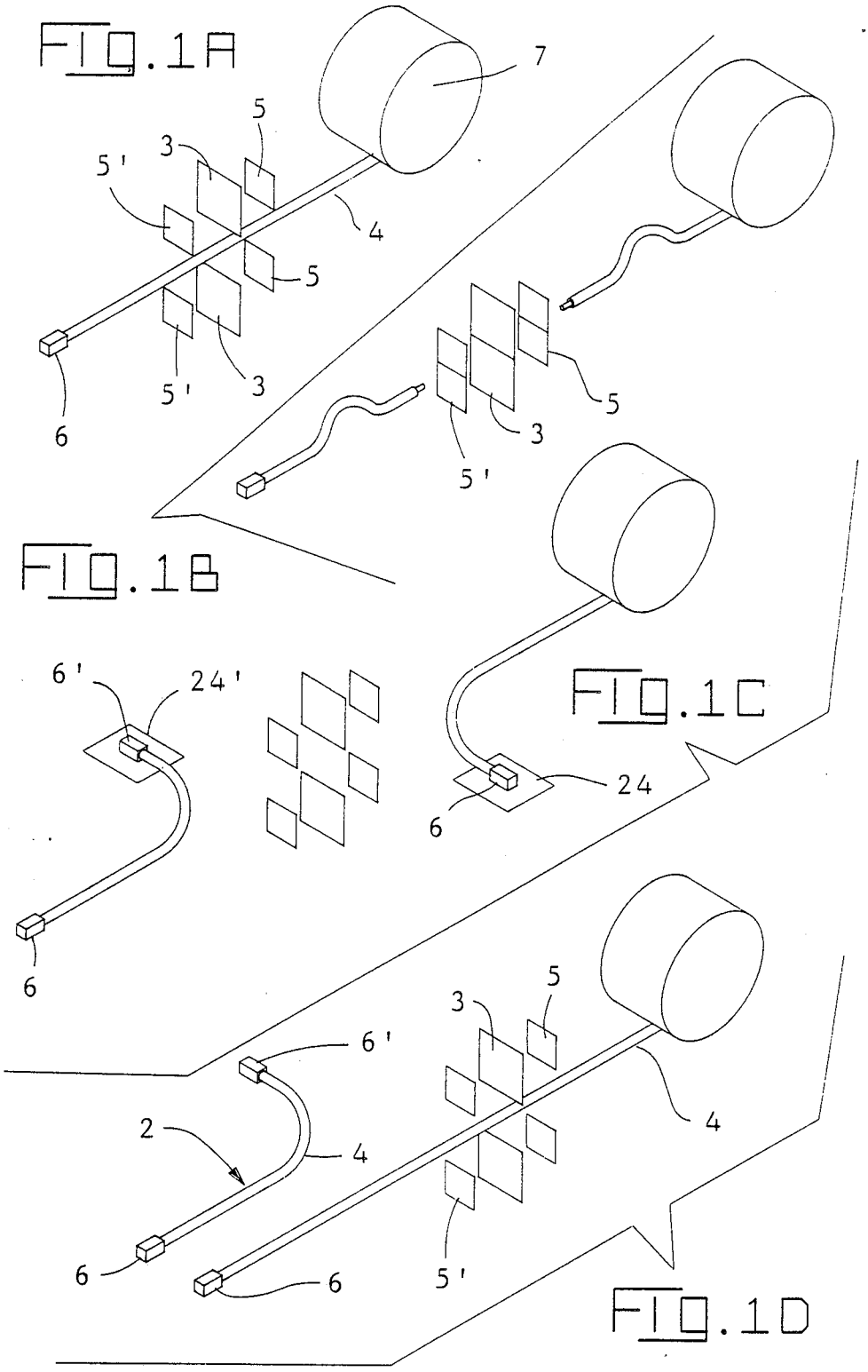
FIGS. 1A–1D are diagrammatic views which illustrate these steps in the manufacture of an electrical lead by a machine in accordance with the invention.

FIGS. 1A–1D show the manner in which electrical leads 2 are produced by machines of the type described below. Insulated wire 4 is supplied from an endless source such as a reel 7 and is fed by a wire feeding means along a wire feed path which extends through and past wire cutting blades 3 and insulating cutting blades 5,5′ which are disposed adjacent to the wire cutting blades. The insulating cutting blades, when closed, circumferentially cut the insulation of the wire so that the end portions of the wire and severed lead can be stripped. After feeding has been carried out, the blades are closed as shown in FIG. 1B and the leading end of the wire, which extends from the spool 7, and the trailing end of the lead are pulled axially thereby to strip the ends of the wire and lead of the insulation. Thereafter, FIG. 1C, the leading end of the wire and the trailing end of the lead are shifted laterally to crimping stations 24, 24′ at which electrical terminals 6, 6′ are crimped onto the ends. The finished lead 2 is stored in a tray (not shown) or the like as shown in FIG. 1D and the wire is then fed so that the section of wire extending through the cutting and stripping zone will have a terminal 6 on its end. The steps described above are then repeated.

Figure 2:
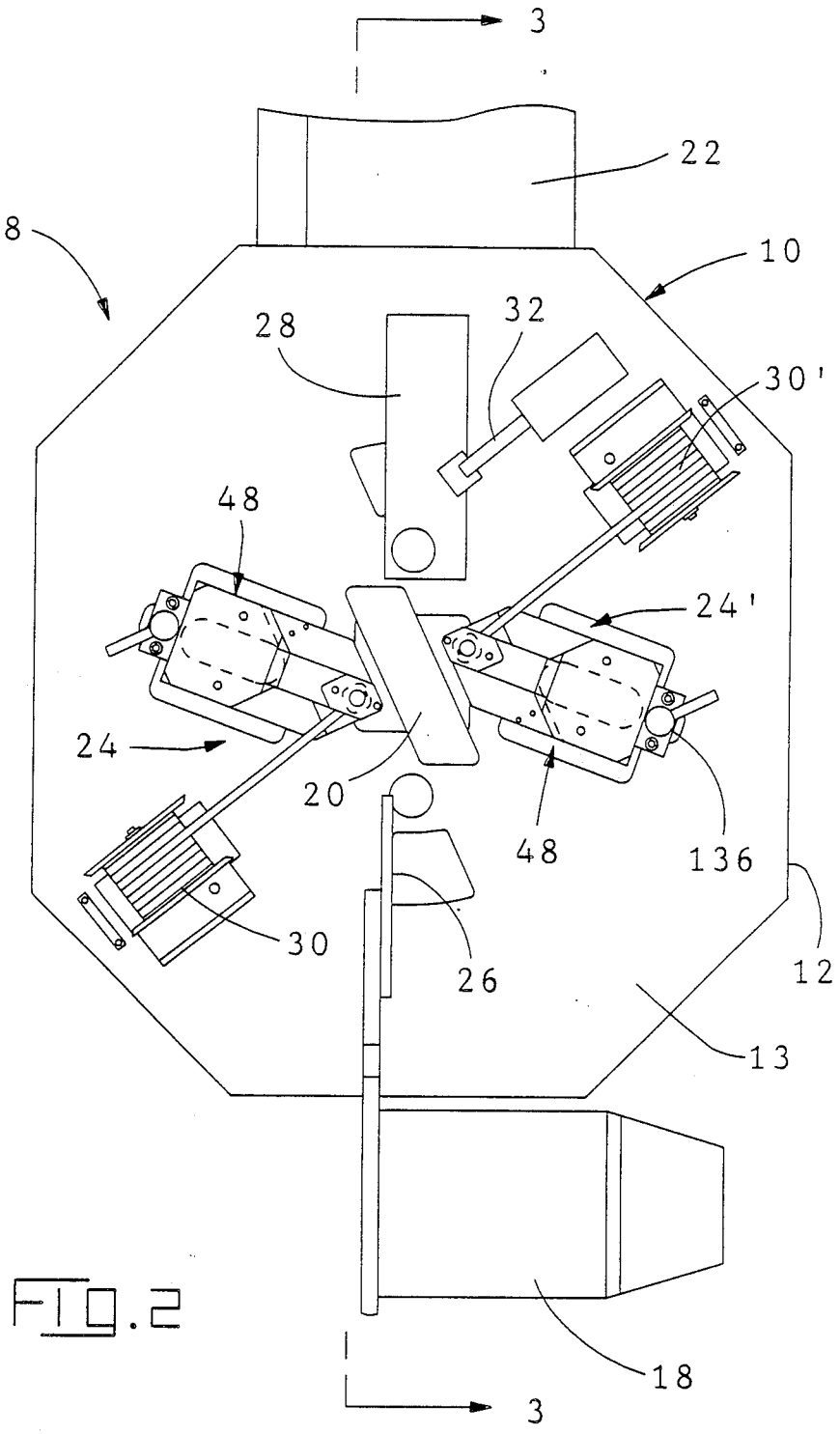
FIG. 2 is a top plan view of a machine in accordance with the invention.
Figure 3:
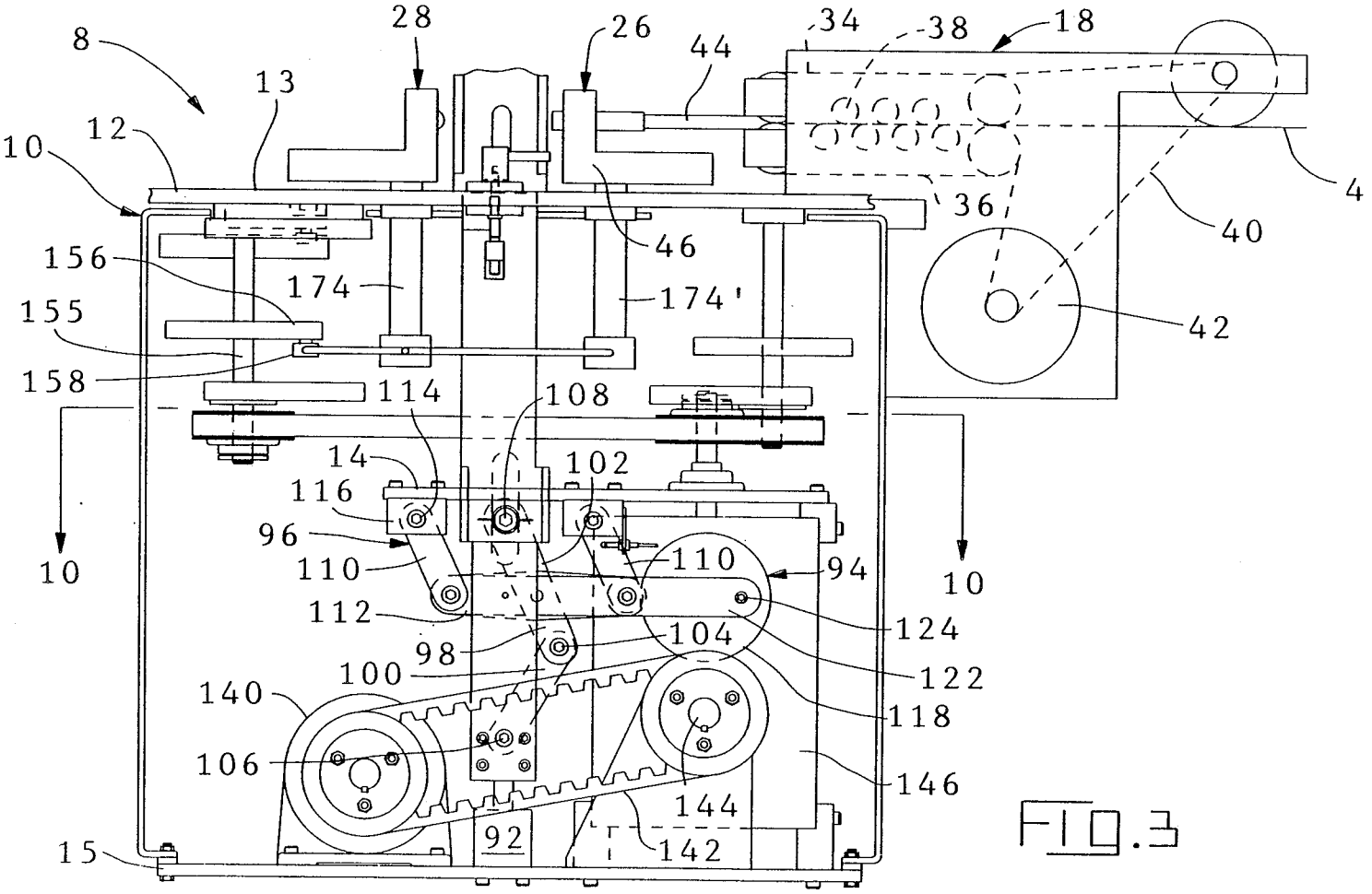
FIG. 3 is a sectional view looking in the direction of the arrows 3—3 of FIG. 2.

Referring to FIGS. 2 and 3, a machine 8 in accordance with the invention has a housing 10 comprising a top plate 12 having an upper surface 13, an intermediate plate 14, and a base plate 15 which rests upon the floor. The wire is fed by a wire feeding mechanism 18 along a wire feed path which extends over the upper surface 13 of the top plate through an upstream guiding and transferring mechanism 26, through a wire cutting and stripping zone 20, and then through a downstream wire guiding and transferring mechanism 28. The wire is fed onto a tray or the like 22 which receives the finished leads during operation of the machine. The terms "upstream" and "downstream" as used above refer to the direction of wire feed from the wire source 7. The terminals 6, 6′ are crimped onto the cut ends at crimping stations 24, 24′ which are located on each side of the feed path adjacent to the cutting and stripping zone 20. Terminals are supplied to the crimping press assemblies 48, 48′ from reels as shown at 30 and 30′. Additionally, a separate transferring mechanism may be provided as shown at 32 for moving the end portion of the finished lead 2 laterally thereby to clear the way for feeding wire during the next operating cycle.

The wire feeding system 18, FIG. 3, comprises upper and lower belts 34, 36 which are mounted on rollers 38 and which have portions of their lengths against each other thereby to feed the wire during movement of the belts. The upper belt 34 is driven by a drive roller which in turn is driven by a chain or the like 40 that extends to an electric motor 42. The upstream guiding and transferring mechanism has a guide tube 44 and a frame 46 which is immediately adjacent to the wire feed mechanism 18. A similar guiding and transferring mechanism is provided downstream from the wire cutting station 28.

The crimping stations 24, 24' have press assemblies 48, 48' therein which are substantially identical to each other so that a description of one will suffice for both and the same reference numerals, differentiated by prime marks, will be used to denote corresponding structural elements in the two crimping press assemblies. The press assembly 48 (FIGS. 5–8) comprises a composite static frame assembly and a composite reciprocable rod. The frame assembly has an upper portion 50, FIG. 6, which is located above the upper surface of the plate 12 and a pair of parallel side plates 52, FIG. 7, which extend downwardly from the plate 12 to, and through, the plate 14. The upper portion 50 is a relatively sturdy casting and has a vertically extending recess 54 which receives the upper portion 64 of the reciprocable rod. The upper portion 50 also has a laterally extending arm 56 which is spaced from its upper end 57 and which supports the frame of the terminal applicator as shown in FIG. 8.

Figure 4:
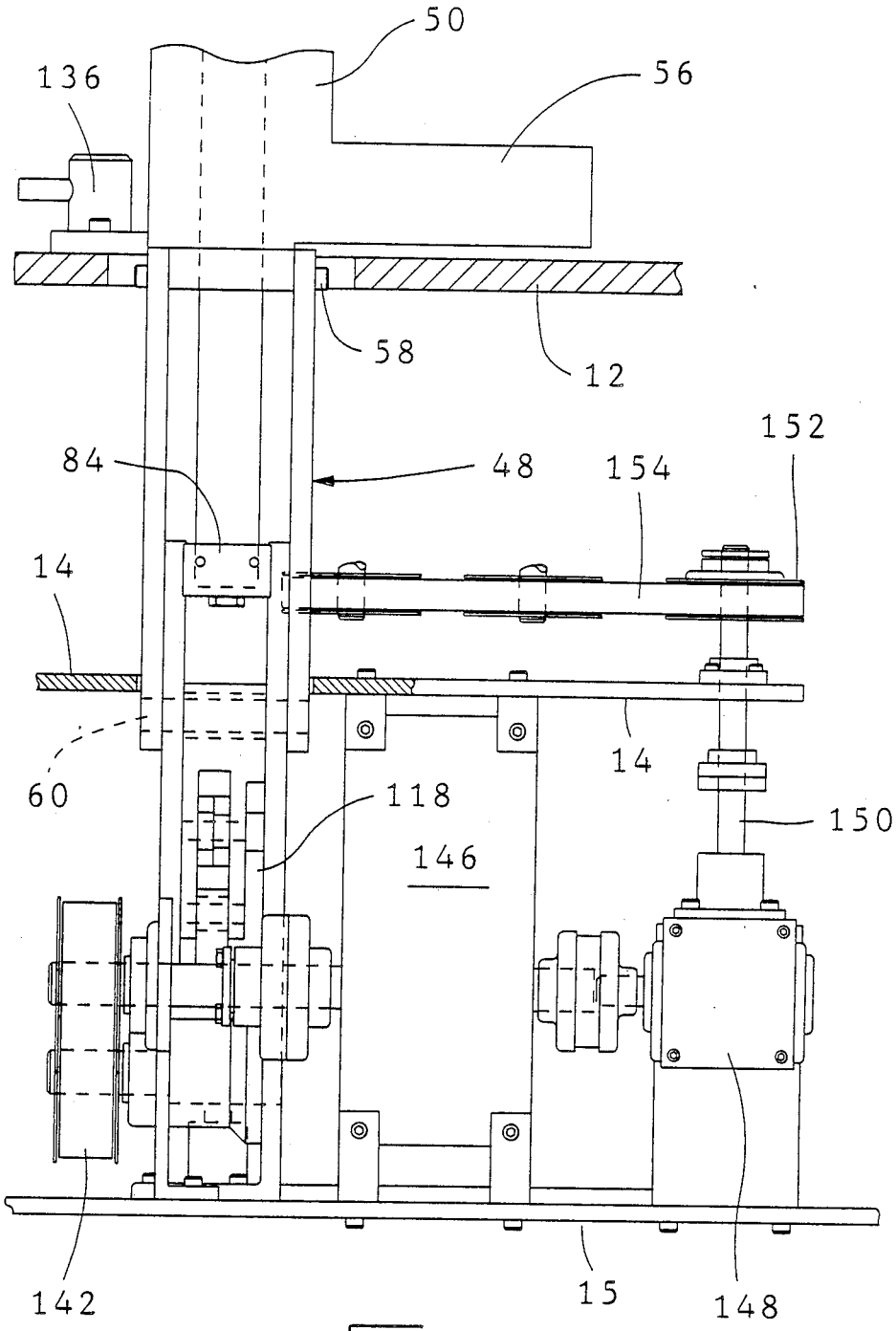
FIG. 4 is a fragmentary side view showing the manner in which the motor is coupled to the power transmission assembly and to the eccentrics which drive the crimping presses.

The parallel frame side plates 52 are secured to the lower end of the upper frame portion 50 by fasteners 58 as shown in FIG. 4. At their lower ends, the side plates 52 are held together by a pin 60 which extends through aligned openings as shown in FIG. 7. The frame assembly comprising the upper and lower portions is adjustable vertically with reference to the upper plate 14 by means of an adjustment mechanism 62 which is described below.

Figure 6:
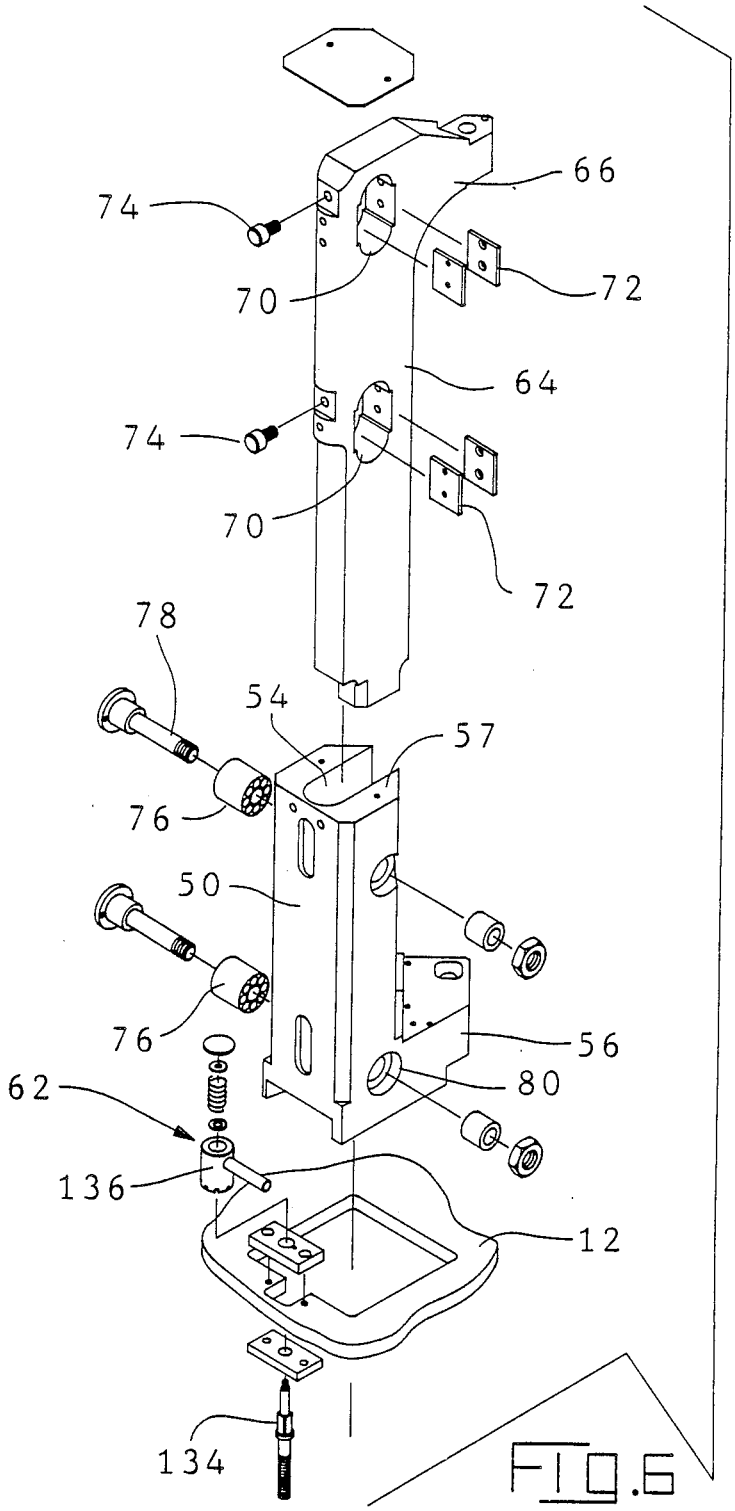
FIGS. 6 and 7 are exploded perspective views of a crimping press assembly, FIG. 6 showing the upper portion of the press assembly and FIG. 7 showing the lower portion of the press assembly.
Figure 7:
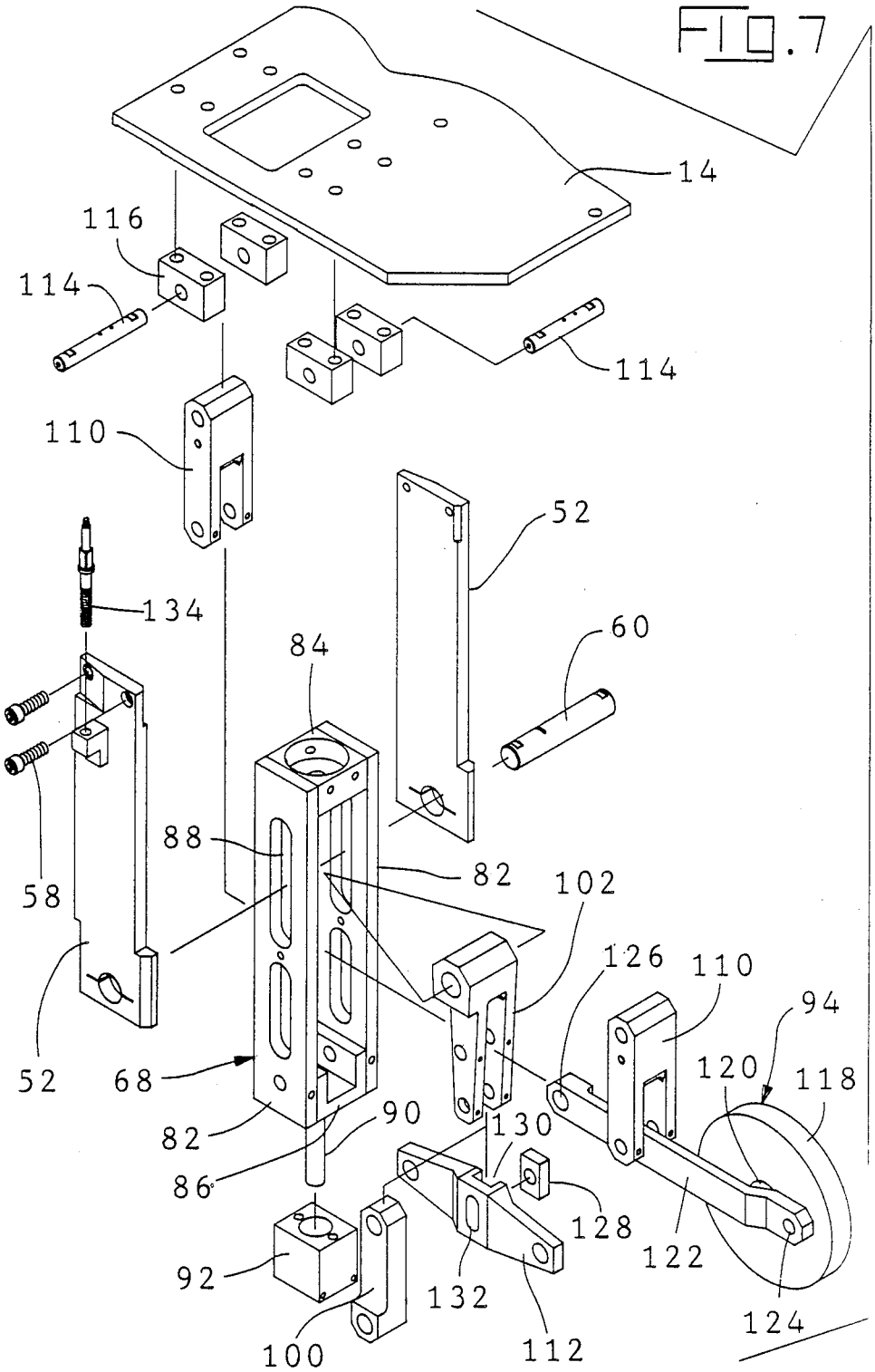
Figure 8:
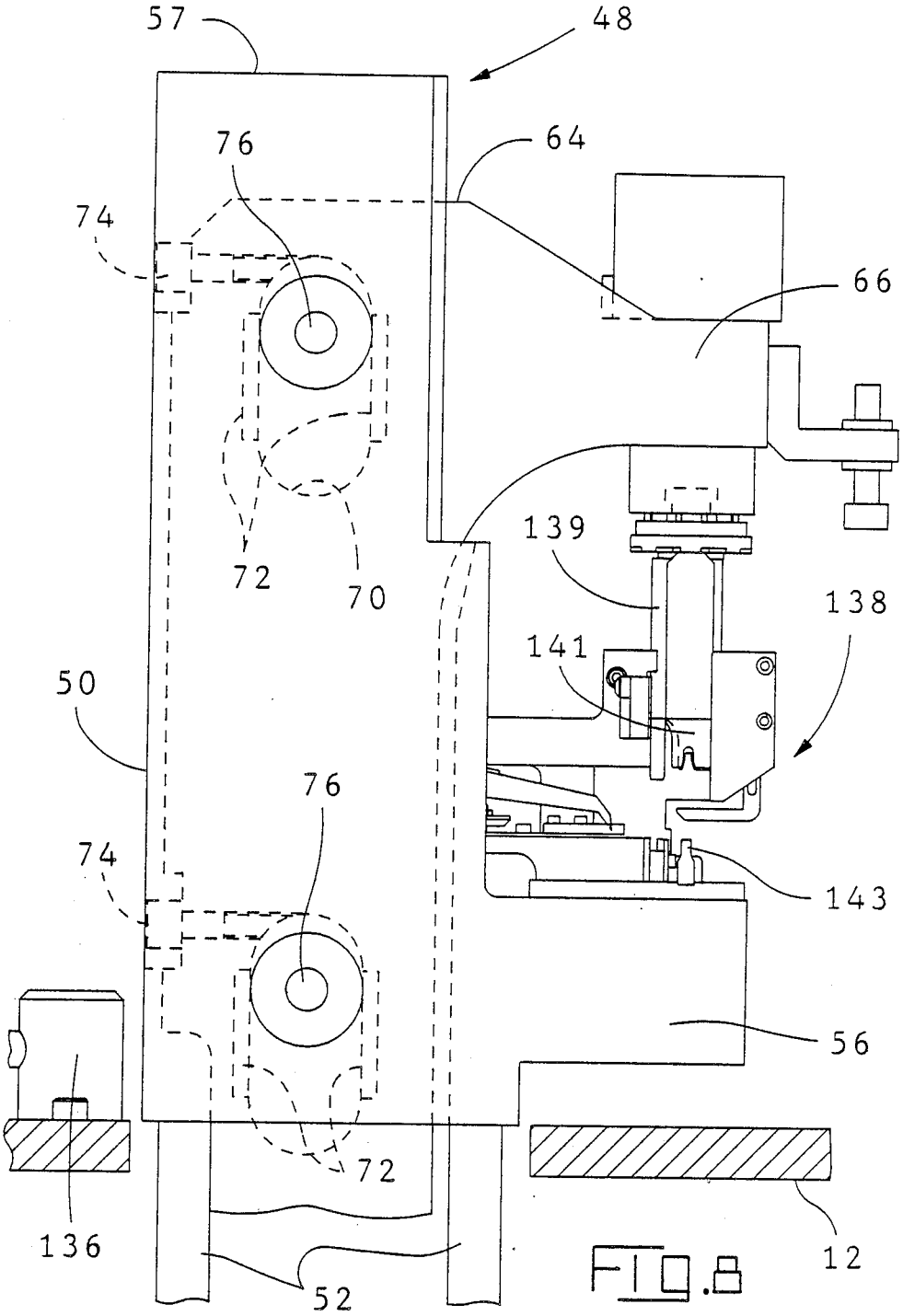
FIG. 8 is a side view, on an enlarged scale, of the upper portion of a press assembly and showing a terminal applicator positioned in the press assembly.
Figure 9:
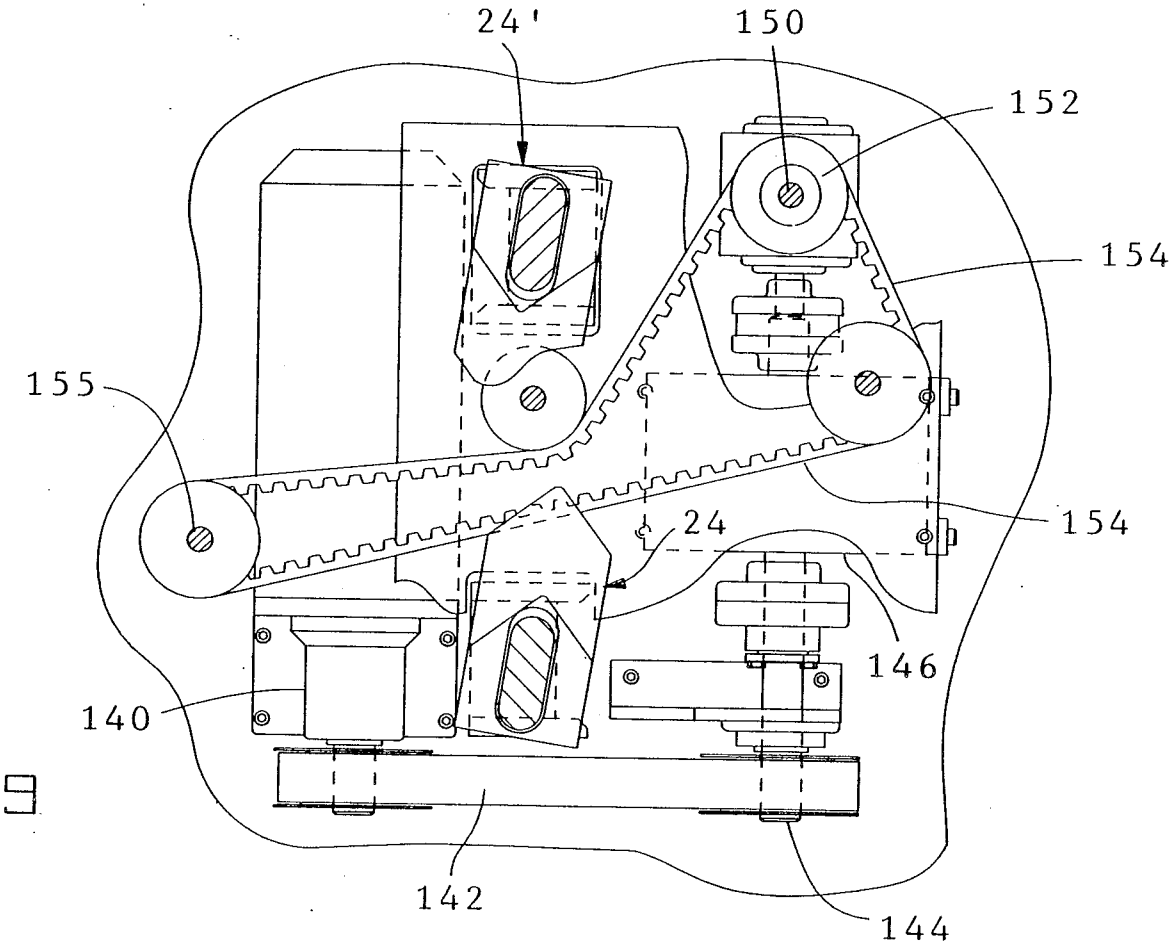
FIG. 9 is a top plan view with portions broken away which shows the relationship of the crimping presses to the actuating means for the transfer mechanism and the power source for the presses.
Figure 10:
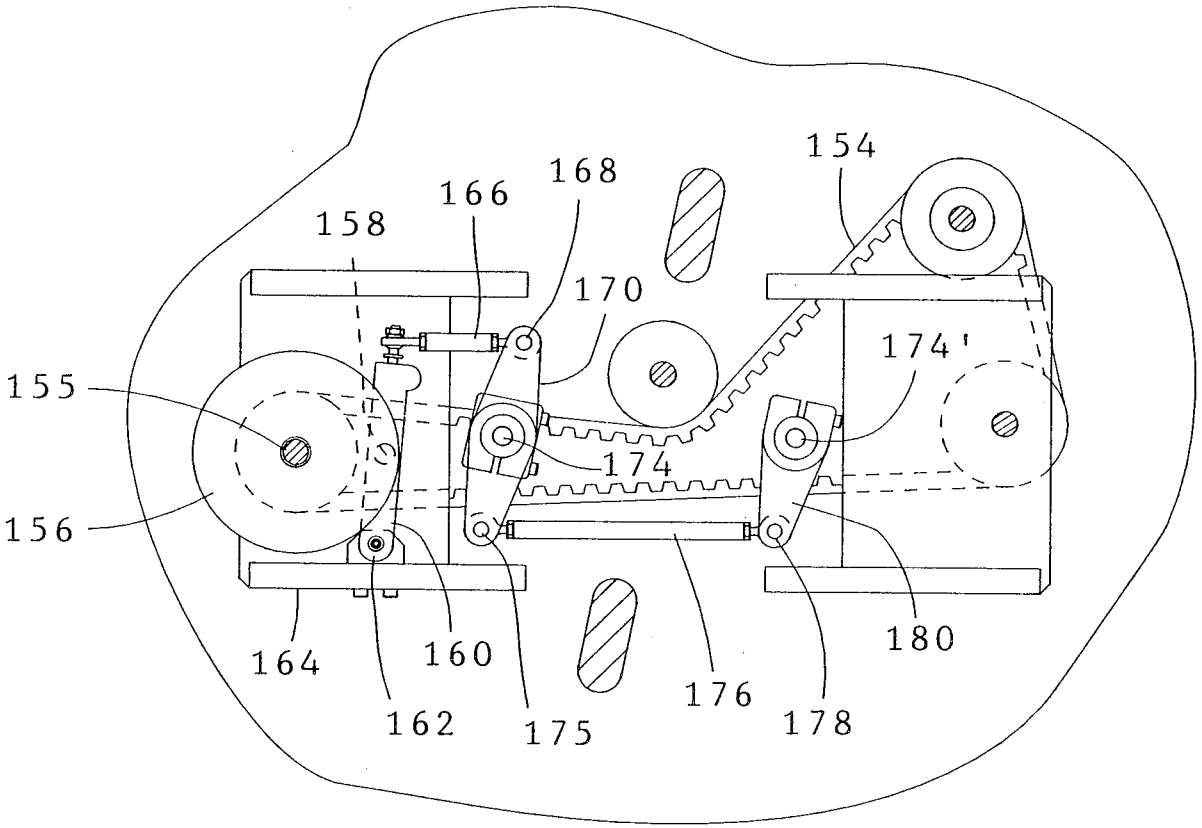
FIG. 10 is a view looking in the direction of the arrows 10—10 of FIG. 3.
Figure 11:
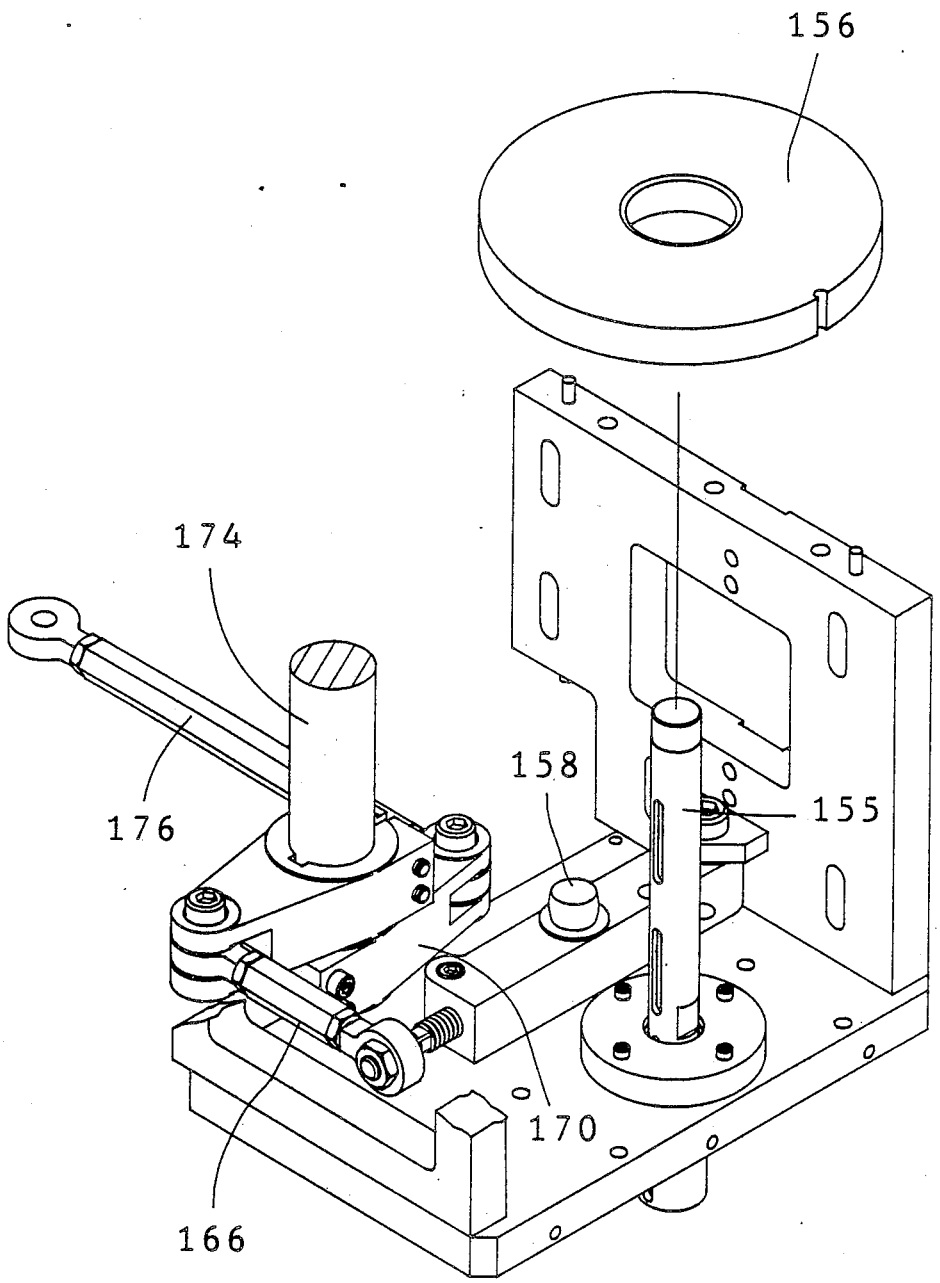
FIG. 11 is a perspective view of the linkage for oscillating one of the wire transfer mechanisms for transferring the cut end of the severed lead from the wire cutting station to a crimping press.

The composite reciprocable rod assembly comprises the upper portion 64 which is secured to a lower cage-like section 68, FIG. 7. The upper portion has a laterally extending arm 66 which is coupled to the ram of the terminal applicator as shown in FIG. 8 and has spaced-apart slots 70 for roller bearings 76 mounted in the static frame section 50. The slots have wear plates 72 therein held in position by fasteners 74 and the bearings 76 are mounted on pins 78 which extend through the static frame section 50 and which are secured therein by suitable bushings and fastening means as shown in FIG. 6.

Figure 5:
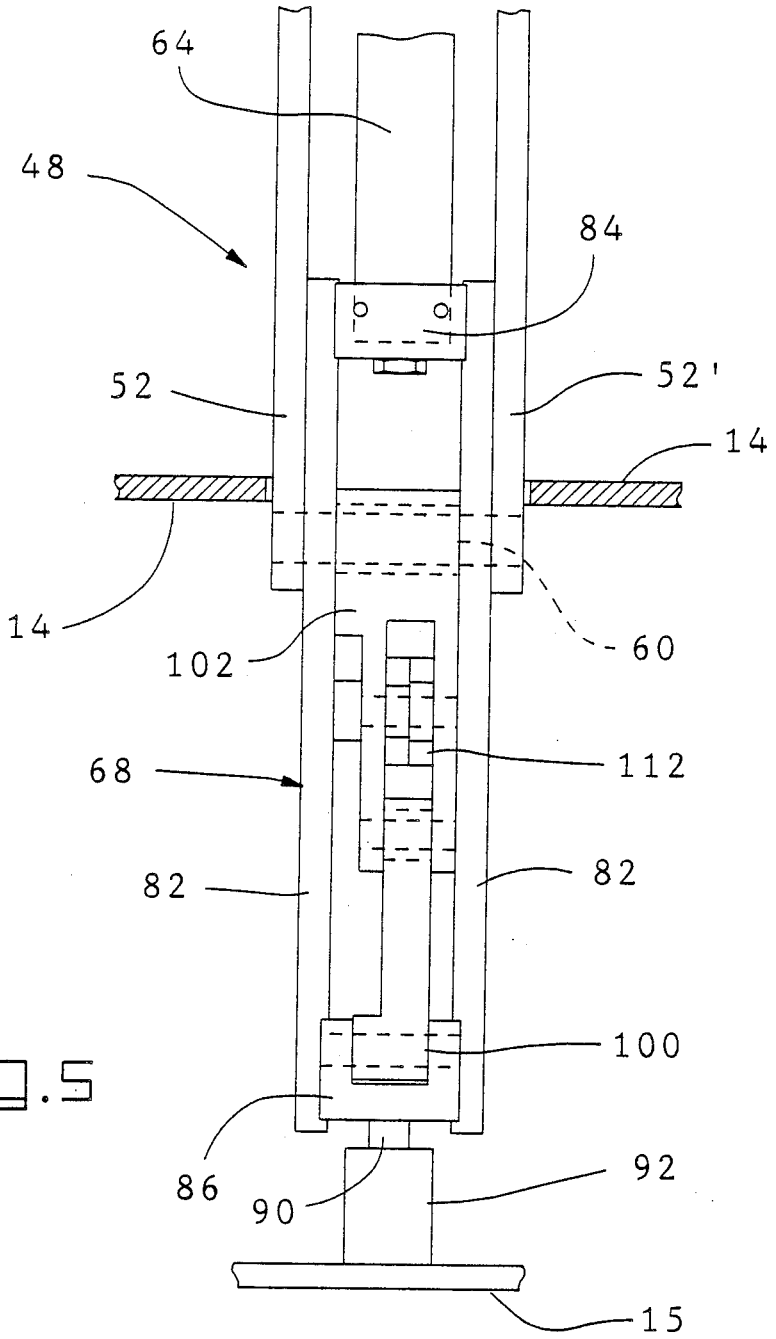
FIG. 5 is a side view of the frame and the reciprocable rod assembly of a crimping press.

The cage-like lower portion of the reciprocable rod assembly comprises spaced-apart cage plates 82 which have a spacer and coupling block 84 between their upper ends by means of which they are secured to the lower end of the portion 64 of the reciprocable rod. A channel-shaped lower spacer block 86 is secured between the lower ends of the plates 82 and provides a pivotal mounting for one link of a toggle mechanism 98 described below. Aligned slots 88 are provided in the plates 82 for the pin 60 to permit movement of the composite reciprocable rod relative to the fixed plates 52 of the static frame. A guide pin 90 extends vertically from the spacer block 86 and is received in a cylindrical opening in a fixed guide block 92 which is secured to the lower housing plate 15 as shown in FIGS. 3 and 5.

The actuator system for the reciprocable rods of the two press assemblies comprises (FIG. 3) an eccentric 94, a four-bar linkage system 96, and a toggle 98. The toggle has a first link 100, a second link 102, and a knee joint 104 at which the two links are pivoted to each other. The first link is pivoted at its other end at a movable pivot 106 in the spacer 86 and the second toggle link is pivoted at 108 to the fixed pin 60. It will be apparent from FIG. 3 that when the toggle links are straightened, the cage-like lower portion of the reciprocable rod assembly will be moved downwardly so that the upper portion of the rod assembly 64 will also be moved downwardly and the arm 66 will be moved towards the surface of the arm 56 on the static frame member 50. Since the arm 66 is coupled to the ram of the terminal applicator 138, the applicator ram is moved downwardly towards the fixed tooling supported on the applicator frame.

The four-bar linkage (FIGS. 3 and 7) comprises parallel vertical links 110 which are connected at their lower ends by a horizontal link 112. The fourth link of the four-bar linkage is surface portions of the plate 14 as will be apparent from FIG. 3. The links 110 are pivoted at 114 to blocks 116 which are secured to the underside of the intermediate plate 14 and are pivoted at their lower ends to the ends of the horizontal link 112. The links 110 are oscillated and the horizontal link 112 is moved to and fro by the eccentric mechanism 94 which comprises a disc 118 which is rotated about its center 120. A connecting rod 122 is pivoted at 124 to an off-center location on the disc and the connecting rod is pivoted at its other end at 126 to link 112 of the four-bar linkage.

In order to permit vertical adjustment of the static frame assembly, as described below, relative to the four-bar linkage, it is necessary that the pivotal connection 126 be vertically movable by the amount by which the static frame of the press assembly is adjusted for the reason that the four-bar linkage mechanism 96 is fixed and is not moved when the frame assembly of the press is moved for purposes of adjustment. The movable pivot is achieved by means of a slide 128 which is slidably received in a recess 130 in the link 112. Also, the pivot pin is received in a vertically extending slot 132 in the link 112 so that the pivot pin 126 can be moved upwardly and downwardly as viewed in FIGS. 3 and 7 relative to the horizontal link 112 of the linkage.

The static frame assembly of each press assembly is adjusted vertically by means of a jack screw 134, shown in FIG. 6. The jack screw is mounted in the upper housing plate 12 and is threaded into the static frame assembly so that rotation of the jack screw will cause the frame assembly to move upwardly or downwardly depending upon the direction of rotation. Each adjusting means has an associated wrench 136 which is spring biased and which is urged into engagement with a non-circular portion of the jackscrew as shown in FIG. 6 so that the jackscrew can be rotated through increments, each of which is translated into linear movement of the static press frame.

As shown at FIG. 8, the applicator 138 is positioned on the arm 56 of the static frame member 50 and the ram 139 of the applicator is coupled to the arm 66 of the reciprocable rod section 64. The applicator ram has the movable crimping tooling 141 thereon while the applicator frame has the fixed crimping tooling 143 thereon. The applicator may be of a conventional type and will not be described in detail.

The actuation system for the machine comprises a single electric motor 140 which reciprocates the reciprocable rod members in the presses and which also operates the wire and lead transferring mechanisms. The motor 140 is coupled by a belt 142 to the input shaft 144 of a transmission 146, see FIGS. 3, 4, 7, 9, and 10. The transmission has output shafts on which the discs 118 of the eccentrics are mounted. In addition, a right angle drive 148 is provided, FIG. 4, having a vertically extending output shaft 150 for driving the wire and lead transferring mechanisms and shifting them from their aligned to their nonaligned position. The output shaft 150 is coupled by means of a belt and pulley system 152, 154 to a vertically extending cam shaft 155 having a cam 156 thereon. The cam has an internal or confined cam track which receives a cam follower 158 on a lever 160. The lever 160 is pivoted at 162 to fixed support plates 164 and is connected at its other end by a link 166 to one end 168 of a lever 170. The lever 170 in turn is secured to a vertically extending rod 174 so that oscillation of the lever 160 will impart oscillatory motion to the lever 170 thereby causing the rod 174 to oscillate. The upper end of the rod 174 has one of the transfer mechanisms 28 mounted thereon as shown in FIG. 3. The other transferring mechanism 26 is mounted on a rod 174', which has an arm 180 secured thereto which is pivoted at 178 to a connecting rod 176 which extends to, and is pivoted at 175 to the previously identified lever 170. It will be apparent that during rotation of the cam 156, the rods 174, 174' will be oscillated thereby to swing the wire transfer devices from their aligned positions to their nonaligned positions and thereby present the stripped ends of the wire and the lead to the crimping presses.

A salient advantage of the invention is achieved as a result of the construction of the presses which have the vertically reciprocable rods that are contained in the press frame. The mass of the presses is reduced and the housing of the machine need not be as massive as the housings of prior presses in which the machine housing serves also as the machine frame. The fact that the presses can be adjusted vertically renders the machine more versatile and avoids difficulties in feeding or crimping oversized terminals.

We claim:

1. A crimping press assembly for crimping electrical terminals onto the ends of wires, the press assembly having fixed tool holder means and movable tool holder means which have fixed and movable crimping tooling thereon respectively, a static press frame means and reciprocable ram means, the fixed tool holder means being carried by the frame means, the movable tool holder means being carried by the ram means, and actuating means for reciprocating the ram means thereby to move the movable crimping tooling between an open position and a closed position, the movable tooling being remote from the fixed tooling when it is in its open position and being proximate to the fixed tooling when it is in its closed position, the crimping press assembly being characterized in that:

the actuating means comprises a reciprocable rod having a guided portion and an actuating mechanism for reciprocating the rod, the frame means comprising means surrounding and guiding said guided portion of the rod, the guided portion of the rod being parallel to the ram means and the rod having one of its ends adjacent to the ram means, the rod being connected to the ram means at the one end, the actuating means having a first portion which is in engagement with the rod and which imparts reciprocative motion to the rod, the actuating means having a second portion which is in engagement with the frame means whereby, during crimping of an electrical terminal onto a wire, the reaction forces resulting from the crimping process are transmitted from the movable and fixed tooling to the rod and the frame means respectively, and through the first and second portions of the actuating means.

2. A crimping press assembly as set forth in claim 1 characterized in that a housing for the press assembly is provided which has one surface that extends normally of the axis of the rod and is proximate to the one end of the rod, and adjusting means are provided for adjusting the location of the press assembly in directions parallel to the directions of reciprocation of the rod whereby, the positions of the fixed and movable tooling relative to the one surface of the housing can be adjusted.

3. A crimping press assembly as set forth in claim 2 characterized in that the press assembly is part of a lead making machine having an operating zone, the operating zone having therein the fixed and movable crimping tooling, a wire cutter, terminal feeding means for intermittently feeding terminals to a position between the fixed and movable tooling, wire feeding means for feeding wire along a wire feed path which extends past the cutter, and transferring means whereby, upon actuation of the wire cutter subsequent to feeding wire along the wire feed path, a lead is cut from the fed wire and the cut ends of the lead and wire will be in the operating zone, the transferring means being effective to transfer one of the cut ends from a location adjacent to the cutter to a location between the fixed and movable crimping tooling, the adjusting means permitting adjustment of the fixed and movable tooling relative to the cut end which is transferred to ensure precise placement of the cut end relative to the tooling.

4. A crimping press assembly as set forth in claim 1 characterized in that the actuating means comprises a toggle mechanism having first and second toggle links which are pivoted to each other at a knee joint, the first portion of the actuating means being the first link, the second portion of the actuating means being the second link, the first and second links being pivoted to the rod and the frame means respectively.

5. A crimping press assembly as set forth in claim 4 characterized in that the frame means and the rod have a common axis, the first and second links being pivoted to the rod and frame means respectively on spaced apart pivotal axes which intersect the common axis of the rod and frame means.

6. A crimping press assembly as set forth in claim 5 characterized in that the toggle mechanism is broken and the knee joint thereof is spaced laterally from the common axis when the movable tooling is in its open position, the knee joint being moved towards the common axis when the movable tooling is moved from its open position towards its closed position.

7. A crimping press assembly as set forth in claim 6 characterized in that the knee joint is on the common axis and the toggle mechanism is straightened with the first and second links in alignment on the common axis when the movable tooling is in its closed position.

8. A crimping press assembly as set forth in claim 7 characterized in that force applying means are provided for straightening the toggle mechanism and returning the toggle mechanism to its broken condition during each operating cycle of the press assembly, the force applying means being mechanically connected to the toggle mechanism and being capable of applying a force thereto in directions normal to the common axis.

9. A crimping press assembly as set forth in claim 8 characterized in that a housing for the press assembly is provided which has one surface that extends normally of the common axis, the one surface being proximate to the one end of the rod, and adjusting means are provided for adjusting the location of the press assembly in directions parallel to the directions of reciprocation of the rod whereby the positions of the fixed and movable tooling relative to the one surface can be adjusted, the force applying means being connected to the toggle mechanism by a connection which permits the adjustment of the press assembly.

10. A crimping press assembly as set forth in claim 9 characterized in that the force applying means is connected to the toggle mechanism by a pivotal connection, the pivotal connection being movable relative to the toggle mechanism during adjustment of the press assembly.

11. A crimping press assembly as set forth in claim 10 characterized in that the force applying means comprises actuator link means which extends transversely of the common axis and past the toggle mechanism, the pivotal connection of the force applying means being a pivotal connection between the actuator link means and one of the toggle links.

12. A crimping press assembly as set forth in claim 11 characterized in that the actuator link means comprises a four bar linkage system having two parallel swinging links on opposite sides of the common axis and a connecting link extending between the swinging links, the connecting link being pivotally connected intermediate its ends to the one toggle links, and a power source is provided for swinging the swinging links, the power source comprising an eccentric and a power transmitting link extending from the eccentric to the connecting link.

13. A crimping press assembly as set forth in claim 1 characterized in that the frame means and the rod have a common axis, the frame means having a laterally extending frame arm proximate to the one end of the rod and the rod has a laterally extending rod arm at the one end, the ram means being connected to the laterally extending rod arm, the fixed tool holder means being carried by the laterally extending frame arm.

14. A crimping press assembly as set forth in claim 13 characterized in that the ram means and the fixed tool holder means are contained in a terminal applicator, the terminal applicator having an applicator frame, the fixed tool holder means being on the applicator frame and the applicator frame being supported on the laterally extending frame arm, the ram means being reciprocable in the applicator frame and being disengageably coupled to the laterally extending rod arm.

15. A lead making machine of the type having a wire feeding means for feeding wire through an operating zone, a wire cutter in the operating zone for cutting a lead from wire which has been fed therethrough whereby the trailing end of the lead and the leading end of the wire are disposed in the operating zone, a leading end crimping press means and a trailing end crimping press means in the operating zone proximate to the wire cutter for crimping terminals onto the leading end of the wire and the trailing end of the lead respectively, a leading end transferring means and a trailing end transferring means for transferring the leading end and the trailing end to the leading end crimping press means and the trailing end crimping press means respectively, the machine being characterized in that:

each crimping press means comprises a vertically extending reciprocable rod and static frame means in surrounding and guiding relationship to the rod, each rod having a laterally extending rod arm and each frame means having a laterally extending frame arm, the arms having opposed portions which move towards and away from each other upon reciprocation of the rods, fixed and movable crimping tooling carried by the frame arm and the rod arm respectively of each press means, and actuating means for reciprocating the rods thereby to move the laterally extending arms and the fixed and movable crimping tooling towards and away from each other.

16. A lead making machine as set forth in claim 15 characterized in that a machine housing is provided which has one surface which extends normally of the rods, the one surface being proximate to, and below, the frame arms, the wire cutting means and the wire transferring means being above the one surface, and adjusting means are provided for adjusting the location of the crimping press means relative to the one surface in directions which are normal to the one surface.

17. A lead making machine as set forth in claim 16 characterized in that a separate adjusting means is provided for each press means, each adjusting means being on the one surface and on the static frame means of the associated press means.

18. A lead making machine as set forth in claim 17 characterized in that each adjusting means comprises a jack screw.

19. A lead making machine as set forth in claim 15 characterized in that a separate actuating means is provided for each crimping press means, each actuating means having first and second portions, the first portion being in engagement with the rod and the second portion being in engagement with the static frame means whereby, during crimping of an electrical terminal onto a wire, the reaction forces resulting from the crimping process in each crimping press means are transmitted from the movable and fixed tooling to the rod and frame means respectively of the associated press means and through the first and second portions of the actuating means.

20. A lead making machine as set forth in claim 19 characterized in that the actuating means for each press means comprises a toggle mechanism, each toggle mechanism having first and second toggle links which are pivoted to each other at a knee joint, the first portion of the actuating means being the first link, the second portion being the second link, the first and second links being pivoted to the rod and the frame means respectively of the associated press means.

21. A lead making machine as set forth in claim 17 characterized in that the actuating means is in a fixed position relative to the crimping press means, the actuating means being coupled to the press means by a coupling which permits adjustment of the positions of the press means relative to the actuating means.

22. A lead making machine as set forth in claim 20 characterized in that the frame means and the rod of each press means have a common axis, the first and second links being pivoted to the rod and frame means respectively on spaced-apart pivotal axes which intersect the common axis of the rod and frame means, the toggle mechanism of each press means being normally broken with the knee joint thereof spaced laterally from the common axis when the tooling is in its open position, the knee joint being moved towards the common axis when the movable tooling is moved towards its closed position.

23. A lead making machine as set forth in claim 22 characterized in that a machine housing is provided which has one surface which extends normally of the rods, the one surface being proximate to, and below, the frame arms, the wire cutting means and the wire transferring means being above the one surface, and adjusting means are provided for adjusting the location of each crimping press means relative to the one surface in directions which are normal to the one surface, each adjusting means being on the one surface and on the static frame means of its associated press means.

24. A lead making machine as set forth in claim 23 characterized in that each toggle mechanism has force applying means for straightening the toggle links thereof, the force applying means comprising actuator link means which extends transversely of the common axis and is pivoted to its associated toggle mechanism in a pivotal connection which permits adjustment of the associated press means.

* * * * *